US006336253B1

(12) United States Patent
Salice

(10) Patent No.: US 6,336,253 B1
(45) **Date of Patent: *Jan. 8, 2002**

(54) FASTENING PLATE FOR THE FASTENING OF A FITTING, E.G. A HINGE ARM, TO A SUPPORTING WALL

(75) Inventor: Luciano Salice, Carimate (IT)

(73) Assignee: Arturo Salice S.p.A., Novedrate/Como (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/362,121

(22) Filed: Jul. 28, 1999

(30) Foreign Application Priority Data

Jul. 28, 1998 (DE) ..... 298 13 447 U

(51) Int. Cl.[7] ..... E05D 5/00

(52) U.S. Cl. ..... 16/382; 16/383; 16/238; 16/384

(58) Field of Search ..... 403/294, 282, 403/277; 16/382, 383, 384, 236, 237, 238

(56) References Cited

U.S. PATENT DOCUMENTS

| | | | | | |
|---|---|---|---|---|---|
| 931,697 | A | * | 8/1909 | Maxwell | 16/384 |
| 972,326 | A | * | 10/1910 | Brent | 16/384 X |
| 1,001,575 | A | * | 8/1911 | Bade | 16/384 |
| 3,201,820 | A | * | 8/1965 | Desrosiers | 16/382 X |
| 4,313,239 | A | * | 2/1982 | Tsuneki | 16/236 |
| 4,654,932 | A | * | 4/1987 | Rock et al. | 16/382 |
| 4,718,143 | A | * | 1/1988 | Lautenschlager, Jr. | 16/238 |
| 4,785,497 | A | * | 11/1988 | Salice | 16/237 |
| 4,800,625 | A | | 1/1989 | Salice | 16/382 |
| 4,847,947 | A | * | 7/1989 | Tsong-Chi | 16/238 |
| 4,862,556 | A | * | 9/1989 | Grass | 16/382 |
| 4,982,476 | A | | 1/1991 | Salice | 16/382 |
| 5,022,116 | A | | 6/1991 | Salice | 16/258 |
| 5,133,109 | A | | 7/1992 | Mariani | 16/238 |
| 5,150,500 | A | | 9/1992 | Bisbing | 16/239 |
| 5,257,437 | A | | 11/1993 | Salice | 16/239 |
| 5,700,105 | A | | 12/1997 | Salice | 403/408.1 |
| 5,966,779 | A | * | 10/1999 | Salice | 16/382 |

FOREIGN PATENT DOCUMENTS

| | | | | |
|---|---|---|---|---|
| DE | 2229657 | * | 1/1974 | 16/383 |
| DE | 2400691 | * | 9/1975 | 16/382 |
| DE | 86 20 441 | | 11/1986 | |
| DE | 270439 | * | 8/1987 | 16/384 |
| DE | 3604984 | * | 8/1987 | 16/382 |
| DE | 38 41 933 | | 6/1990 | |
| DE | 295 08 286 | | 10/1995 | |
| DE | 297 13 595 | | 11/1997 | |
| EP | 346633 | * | 12/1989 | 16/382 |
| HU | 207 565 | | 4/1993 | |

* cited by examiner

*Primary Examiner*—Lynne H. Browne
*Assistant Examiner*—David E. Bochna
(74) *Attorney, Agent, or Firm*—Jacobson Holman, PLLC

(57) ABSTRACT

A fastening plate for the fastening of a fitting to a supporting wall including a bottom plate, provided with two boreholes for fastening screws and with two base-like elevations, and a top plate, at least partially covering the bottom plate, and having an elongated center piece with devices for the fastening of the fitting and at the sides wing-like protrusions provided with oblong holes whose center lines are at right angles to the center line of the center piece and which are also penetrated by the fastening screws with base-like elevations engaging the oblong holes of the top plate as guide pieces. The boreholes lie on the center line of the bottom plate with a spreading dowel-like extension being formed on one borehole and with the other borehole bearing in its base-like elevation a pre-mounted screw sized so that its thread cuts into the wall of the borehole provided in the supporting wall.

15 Claims, 5 Drawing Sheets

FASTENING PLATE FOR THE FASTENING OF A FITTING, E.G. A HINGE ARM, TO A SUPPORTING WALL

BACKGROUND OF THE INVENTION

1. Field of the Invention

The invention relates to a fastening plate for the fastening of a fitting, e.g. a hinge arm, to a supporting wall.

2. Description of the Related Art

In a fastening plate known from DE 86 20 441 comprising a bottom plate and a top plate covering it at least partially, the bottom plate is provided on its bottom side with integral dowels whose boreholes align with the boreholes of the bottom plate. This aspect is advantageous, in particular in the case where the fastening plate is supplied already pre-mounted to the hinge arm connected to the door, as the door can then already be hung on the supporting wall by inserting the dowels into the pre-drilled fastening holes before the fastening screws are fully screwed in and before the dowels are thereby spread. If such fastening plates are intended to be mounted to opposite sides of a supporting wall in a twin fixture, their mounting is only possible if the supporting wall is so thick that the fastening screws or the dowels can be inserted in the aligned boreholes of the supporting wall in such a way that they do not impede one another. However, such a connection is usually unsatisfactory.

In a fastening plate known from DE 297 13 595 U, the boreholes or dowels of the bottom plate and the oblong holes, which are penetrated by fastening screws, of the top plate are disposed opposite each other at equal distances to the transverse axis of the top plate running through the wing-like projections so that two fastening plates provided with corresponding boreholes disposed in pairs next to each other for the fastening screws can be mounted in a twin fixture on opposite sides of a supporting wall. However, this aspect requires a special and complex preparation of the supporting wall which does not correspond to the standardised borehole distribution in the supporting wall.

SUMMARY OF THE INVENTION

It is therefore the object of the present invention to provide fastening plates of the type first described which can initially provisionally be pre-mounted and then fastened in a superposable twin fixture on opposite sides of a thin supporting wall without having to make any special preparations therefor.

This object is solved in accordance with the invention on the basis of a fastening plate in which, on the one hand, a spreading dowel is integrally formed in a homogeneous material to the borehole of the bottom plate, said dowel having a shorter length than usual, and, on the other hand, possesses a borehole partially encompassed by base-like elevations and having a pre-mounted screw which is also shorter, but which has a larger diameter so that it cuts directly into the walls of the boreholes pre-drilled into the supporting wall after mounting.

The fastening plate in accordance with the invention can be pre-mounted superposably in a twin fixture on opposite sides of a supporting wall because the dowels can be inserted into the pre-drilled fastening holes with a low driving fit. If then only those fastening screws aligned therewith are fully screwed in, the spread of the dowels is not yet sufficient to ensure a good fastening as the length of both the dowels and the spreading screws are too small in size. In the fastening plate in accordance with the invention, however, the second fastening screw is designed in a comparatively larger diameter so that it can also ensure a better retaining force even in limited length. Such screws can, for example, be designed as "Euro screws", i.e. as screws possessing a thread diameter of 6.4 mm.

Accordingly, both boreholes of the bottom plate can be encompassed in a known manner by the base-like elevations which serve as guidance in the adjustment of the top plate with respect to the bottom plates. For the better retention and alignment of the screws with a larger diameter, the top plate can be provided with short tongues bent down at the side at the edges of the oblong hole. In this way, both plates can be properly pre-mounted on top of each other as the threads cut partially both into the tongues and the base-like elevations.

As already known from DE 297 13 595 U, in accordance with another advantageous aspect, an elevation designed as a tenon can be disposed in the end region of the bottom plate provided with the dowel, which elevation engages an oblong hole of the top plate parallel to the oblong holes penetrated by the fastening screws for guidance and centration.

The fastening plates in accordance with the invention can also be mountable in the provided boreholes of the supporting wall after being turned through 180° so that they are suitable for both left and right fixtures.

A further solution to the object defined above is given by a fastening plate in which, in a region of the bottom plate which lies below the elongated part of the top plate in the mounted state, at least one dowel-like extension or two bent tongue-like extensions are formed. With this design, it is possible to provide pre-mounted screws with a comparatively larger diameter ("Euro screws" with thread diameters of 6.4 mm) in both screw holes.

According to further aspects of this solution two dowels can be formed at a distance to one another on the bottom plate. Furthermore, on the bottom plates—in the region of the edges of the fastening boreholes—tongues pointing downwards can be formed on integrally which serve the centration and correct alignment of the fastening plate. When the screws are being screwed in, these tongues are deformed by the screws. If bent, tongue-like extensions are provided, their edges may have a slightly slanting course with respect to their symmetric line. In this way, these bent tongues, which replace the dowels alternatively provided, ensure a provisional retention in the boreholes of the furniture panel. In addition, the boreholes in the bottom plate for the pre-mounted fastening screws can be designed hexagonally. By cutting at six points, a better centration or alignment of the fastening screws can be ensured.

BRIEF DESCRIPTION OF THE DRAWINGS

Further details and advantages of the invention are described in more detail by means of an embodiment presented in the drawing in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The mounting plates 12 mountable superposably in a twin fixture to a supporting wall 10 consist of a bottom plate 14 and a top plate 16.

Figure 3:
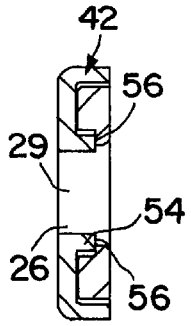
FIG. 3: shows a section through the mounting plate of FIG. 2 along the line III—III.
Figure 2:
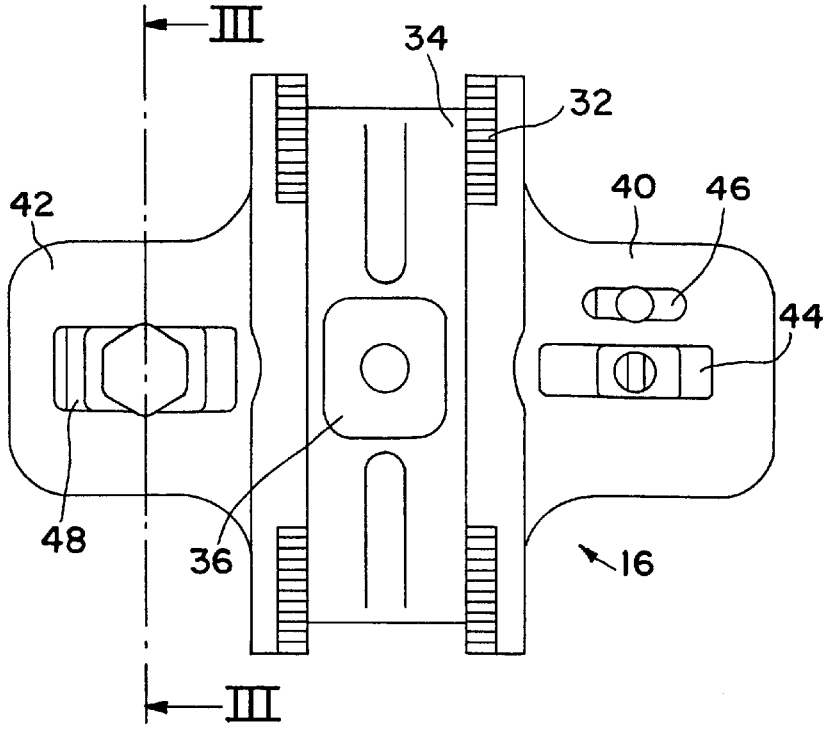
FIG. 2: shows a top view of the fastening plate of FIG. 1.
Figure 4:
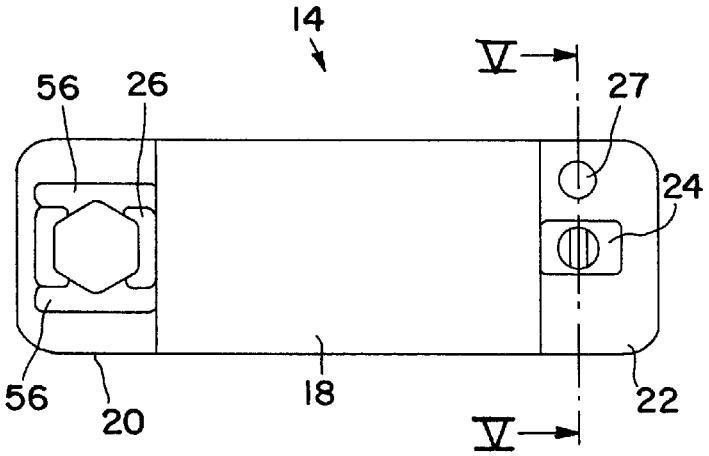
FIG. 4: shows a top view of the bottom plate of the fastening plate.
Figure 5:
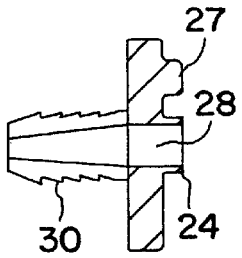
FIG. 5: shows a section through the bottom plate along the line V—V in FIG. 4.
Figure 6:
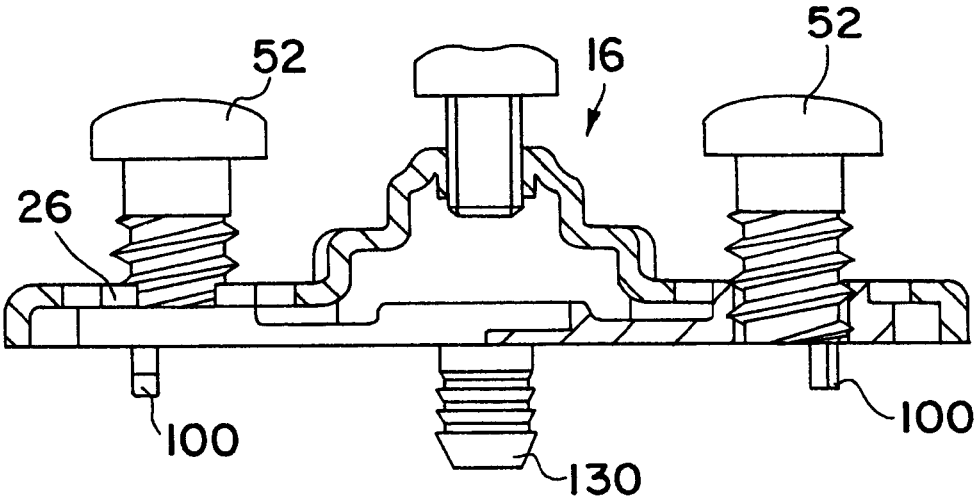
FIG. 6: shows a section through the fastening plate in accordance with a further embodiment of the present invention.
Figure 7:
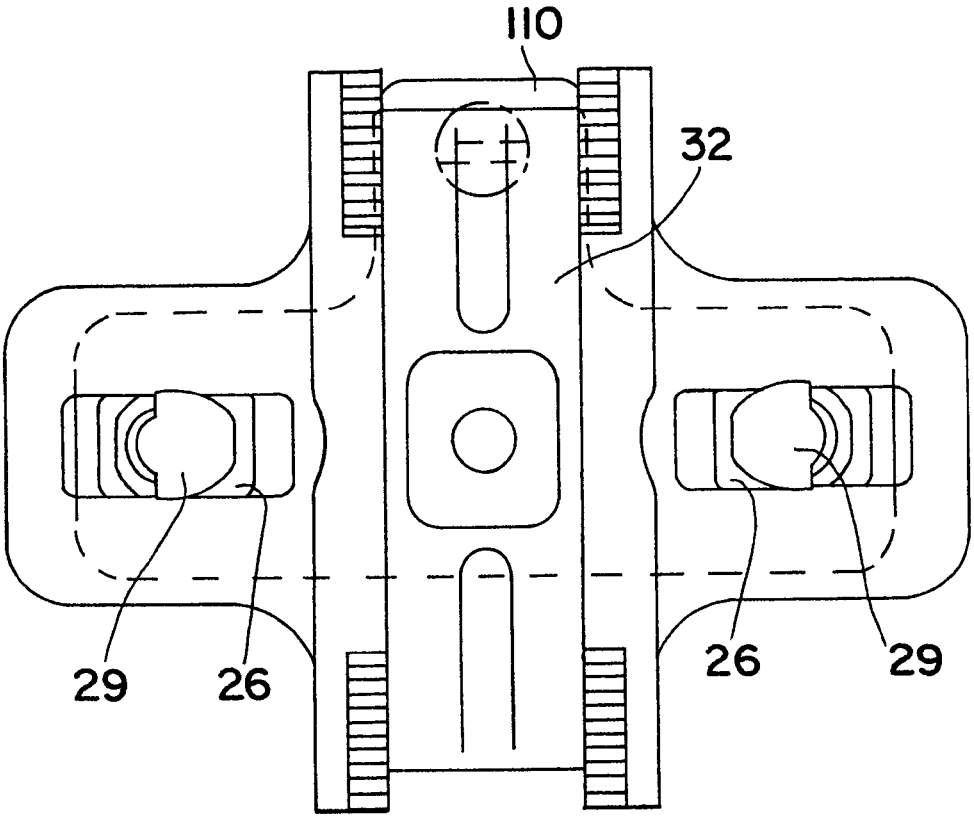
FIG. 7: shows a top view of the fastening plate of FIG. 6.

The bottom plate 14 possesses an essentially rectangular circumferential shape with rounded corners. It consists of a centre piece 18 of lower thickness to which thickened end regions 20, 22 connect via a step-shaped shoulder. In the end region 22 (see FIG. 4), a rectangular base-like elevation 24 and a tenon-like elevation 27 are disposed. On the opposite end 20, two base-like elevations 26 are designed. On both sides and at a small distance from the base-like elevation 26, recesses 56 forming guides are formed (FIG. 3).

The base-like elevations possess through-holes 28, 29 for fastening screws 50, 52. Below the bottom plate 14, the through-hole 28 opens into a dowel-like extension 30 which is designed to be comparatively short.

The bottom plate 14 is formed symmetrically to its transverse centre line. It is manufactured integrally from an injection moulded plastic part.

The top plate 16 consists of an essentially rectangular centre piece 32 provided with a U-shaped profiled elevation 34 which bears in its centre a base-like elevation 36 provided with a taphole. The elevation 34 is designed in such a way that it can be overlapped by a U-shaped profiled hinge arm of a furniture hinge which can be fixed in place on the centre piece 32 by a fastening screw 38. Wing-like protrusions 40, 42 are formed onto the centre piece 32 symmetrically to the transverse centre line. Oblong holes 44, 48 are disposed on the transverse centre line in said wing-like protrusions 40, 42. The centre lines of said oblong holes 44, 48 are therefore in alignment with the transverse centre line of the wing-like protrusions 40, 42. The oblong holes 44, 48 are rectangular and possess a width corresponding to the width of the base-like elevations 24, 26. The oblong hole 46 possesses a width corresponding to the tenon-like elevation 27.

The top plate 16 consists of a stamped metal sheet and is provided with bent edges which run over the edges of the wing-like protrusions 40, 42 and the connecting long sides of the centre piece 32. In addition, in the region of the oblong hole 48, a tongue 54 is formed on each side laterally bent downward at the edges of said oblong hole 48 which tongue 54 serves the better retention and alignment of the screw 52.

The end regions 20, 22 of the bottom plate 14 are covered by the wing-like extensions 40, 42 of the top plate 16. Here, the bottom plate 14 is shorter than the distance between the outer bent edges of the wing-like protrusions 40, 42 so that the top plate 16 can be pushed over the length of the oblong holes 44, 46, 48 for adjustment on the bottom plate 14.

The base-like elevations 24, 26 are so much lower than the thickness of the top plate 16 that the top plate 16 can be tensioned by tightening the fastening screws of the bottom plate 14 or the supporting wall 10.

The screw holes 58 in the supporting wall are provided as exit boreholes for twin mounting.

Figure 1:
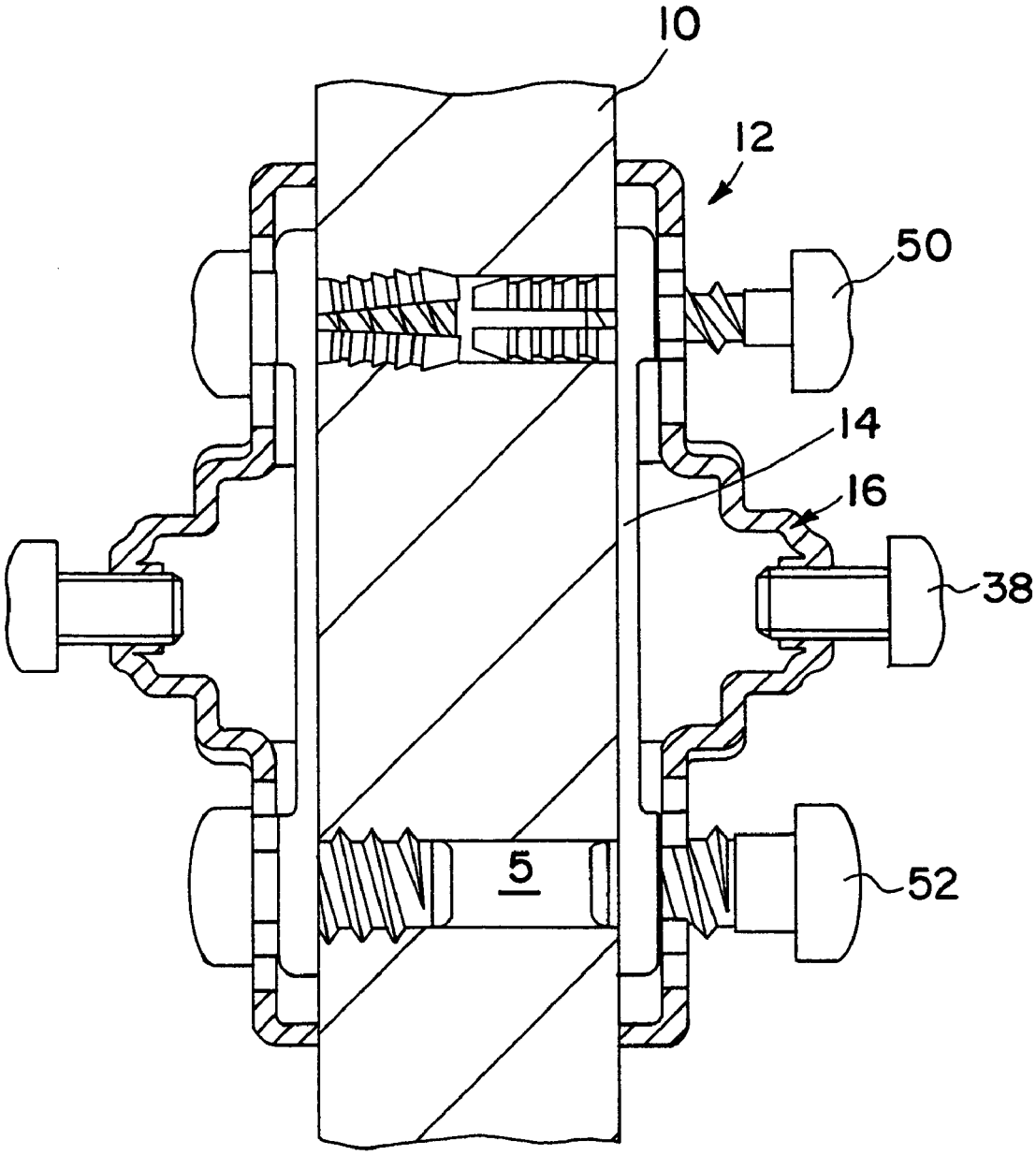
FIG. 1: shows a section through the fastening plate mounted to a supporting wall in a twin fixture in accordance with an embodiment of the present invention.

In FIG. 1, a fastening plate 12 provisionally pre-mounted on the supporting wall can be seen on the right as it is supplied with the usually pre-mounted hinge arm (not shown). On the left, the fastening plate can be seen after the fastening screws have been fully screwed in and the dowels spread. In the pre-mounting such as can be seen on the right hand side of FIG. 1, the fastening plate is first held by the dowel-like extension which is inserted with a low driving fit into the pre-drilled fastening hole 58. Then the fastening screw 50 is screwed into the dowel-like extension so that this is spread. The dowel-like extension is, however, designed to be so short—in order to allow the twin assembly in the comparatively thin supporting wall—so that a sufficient retention is not yet ensured. This is achieved by turning in the comparatively thicker screws 52 whose thread pitches turn into the borehole 58. This thicker screw 52 is a Euro screw with a thread diameter of 6.4 mm.

Further embodiments of the invention are shown in FIGS. 6 to 11. In these embodiments, boreholes 29 are provided on both sides of the bottom plate 114 (see FIGS. 8, 9) or 124 (see FIGS. 10, 11) encompassed partially by base-like elevations 26 having pre-mounted screws 52 possessing a larger diameter.

Figure 9:
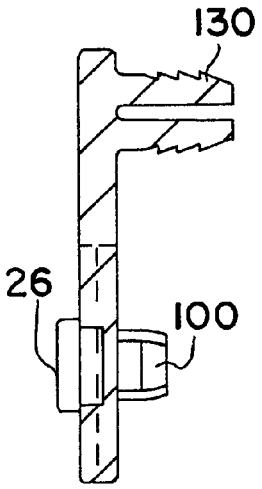
FIG. 9: shows a section through the bottom plate along line IX—IX in FIG. 8.
Figure 8:
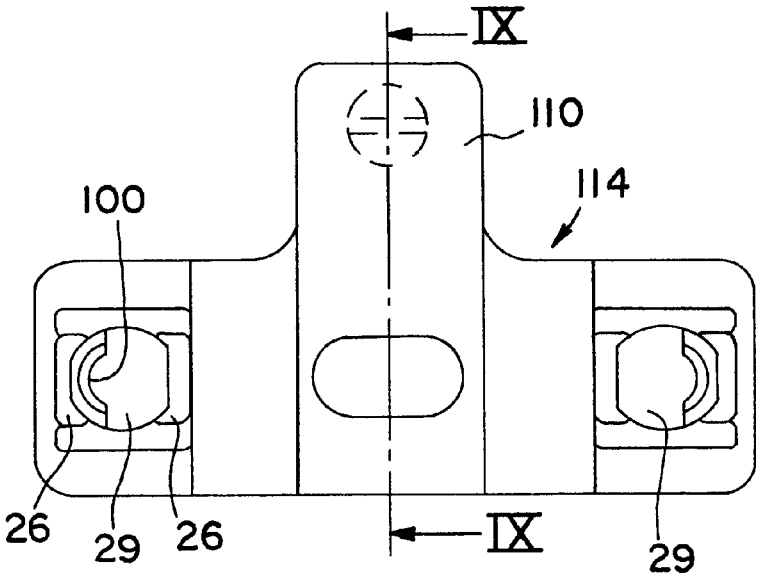
FIG. 8: shows a top view of an embodiment of a bottom plate of the fastening plate of FIG. 6.

A dowel 130 serving the pre-mounting is shaped on one side on the part 110 of the bottom plate 114, as it is shown in FIG. 8, which lies below the elongated centre-piece 32 of the top plate 16 in the mounted state. The dowel 130 shown here is—as is shown in FIG. 9—provided with a tooth-like profile. Said dowel is formed resiliently due to a central slot.

Figure 11:
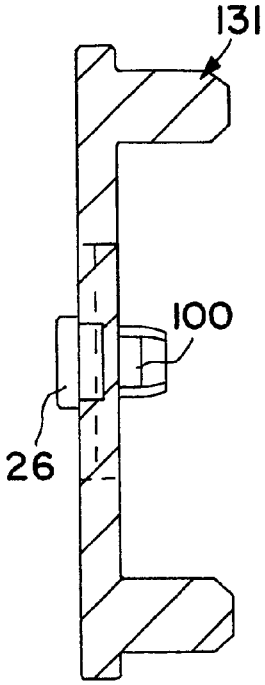
FIG. 11: shows a section through the bottom plate along line XI—XI in FIG. 10.
Figure 10:
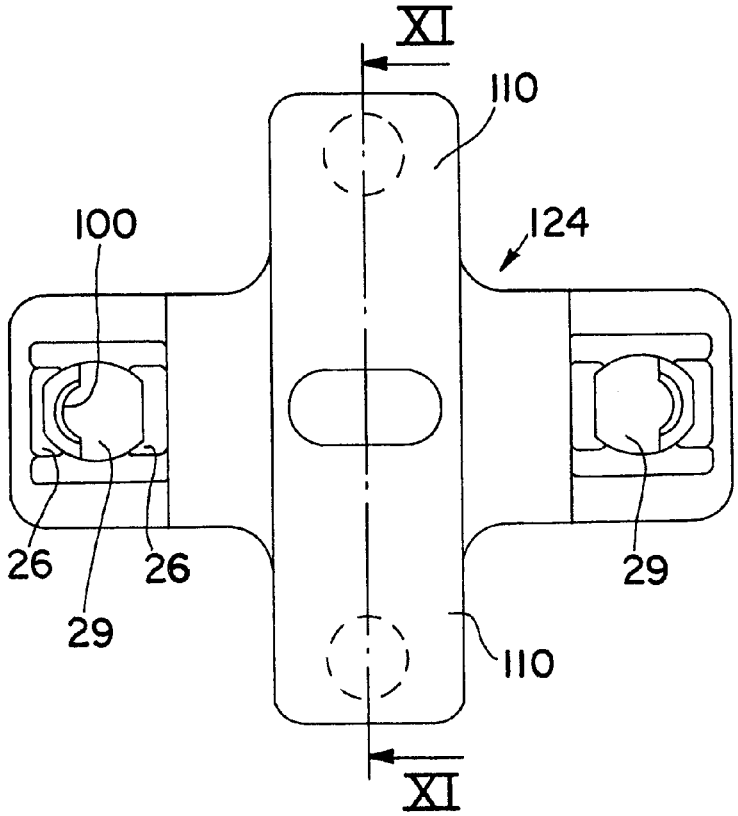
FIG. 10: shows a top view of an alternative embodiment of a bottom plate to the fastening plate of FIG. 6.

In accordance with FIGS. 10 and 11, dowels 130 serving the pre-mounting can also be shaped on both sides in each case on the part 110 of the bottom plate 124 lying under the elongated centre piece 32 of the top plate 16 in the pre-mounted state. The dowel shown in section in FIG. 11 has a smooth circumference 131. The dowels are sized so that they can be inserted manually into the pre-drilled borehole of the furniture panel.

Appropriately, the dowels 130 possess, if corresponding embodiments are provided in accordance with FIG. 11, the same standardised distance, for example 32 mm, as the fastening boreholes 29.

In the embodiment of FIGS. 6 to 11, it is provided that tongues 100 pointing downwards are formed integrally on the edges of the fastening boreholes 29, which tongues make the centration and correct alignment of the fastening plate easier. The disposition of the tongues 100 can be seen from FIGS. 6 to 11. These tongues are deformed by the screws 52 when these are screwed in.

Figure 12:
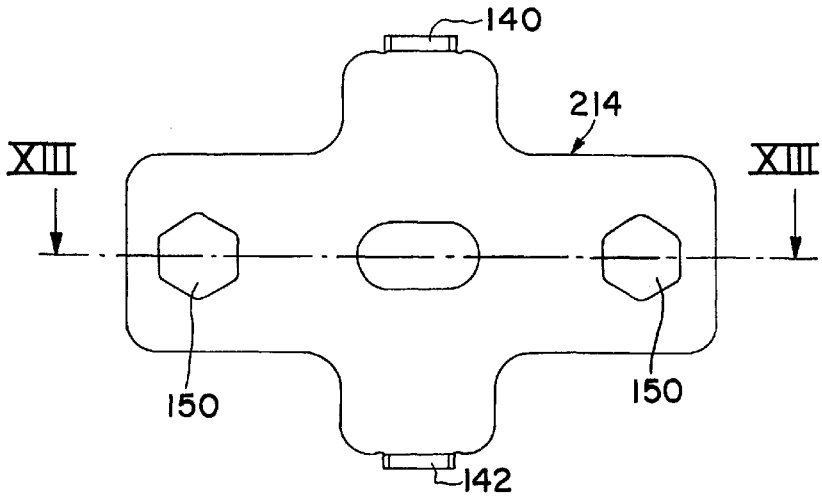
FIG. 12: shows a top view of another alternative embodiment of a bottom plate to the fastening plate of FIG. 6.
Figure 13:
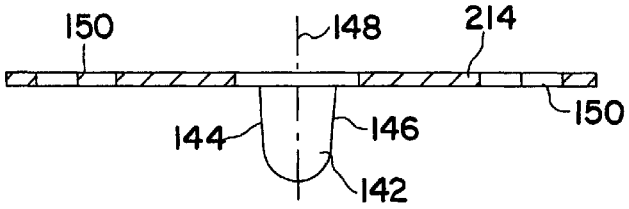
FIG. 13: shows a section through the bottom plate along the line XIII—XIII in FIG. 12.
Figure 14:
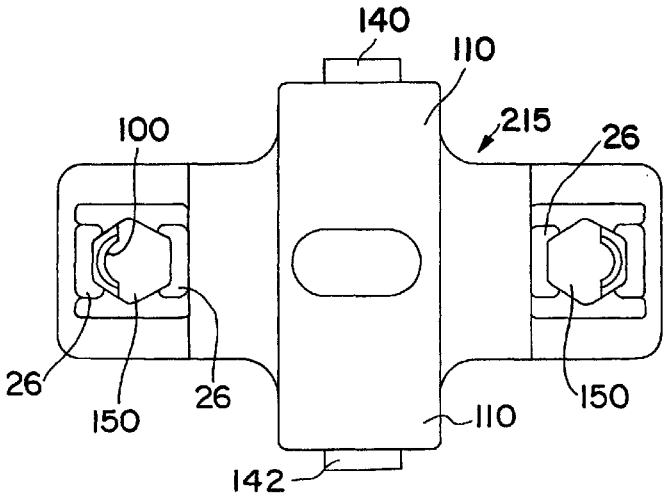
FIG. 14: shows a top view of a further alternative embodiment of a bottom plate to the fastening plate of FIG. 6.

In FIGS. 12, 13 and 14, further embodiments of the invention are shown. In these embodiments, bottom plates 214, 215 are shown. Bottom plate 214 is made integrally from steel. In their shaping, these bottom plates 214, 215 are similar to the bottom plate 124 of FIGS. 10 and 11. Instead of a dowel, however, two bent tongue-like extensions 140, 142 are formed here at the side in each case which ensure a provisional retention in the boreholes of the furniture panel. The edges of these tongues 140, 142 are slightly slanted downwards with respect to their symmetric axis 148 as can be seen from the course of the edges 144, 146 in FIG. 13. The screw holes 150 in these embodiments are formed hexagonally. When the fastening screws are turned in, these cut in at six points and thus allow a better centration or alignment. The tongues 140 and 142 are shown in plane form in FIGS. 12 and 13. However, they can also have a curved surface (not shown here).

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A fastening plate in combination with at least a first fastening screw for the fastening of a fitting to a supporting wall, said fastening plate comprising a bottom plate provided with first and second boreholes, each of said boreholes having a base-like elevation, a top plate at least partially covering the bottom plate and having an elongated center piece with devices for fastening of the fitting and wing-like protrusions at sides thereof with oblong holes whose center lines are at right angles to a center line of the center piece, said base-like elevations extending through the oblong holes of the top plate as guide pieces, said first fastening screw penetrating a respective one of the oblong holes and the first borehole, said first and second boreholes lying on a center line of the bottom plate with a spreading dowel-like extension formed on said second borehole for receiving an additional fastening screw and with said first borehole bearing in its base-like elevation said first fastening screw, said first fastening screw being a pre-mounted fastening screw sized to have a larger diameter in its threaded portion than a threaded portion of said additional screw, the threaded portion of said first fastening screw for cutting into a wall of a borehole provided in the supporting wall.

2. The fastening plate in accordance with claim 1, wherein the top plate possesses short tongues bent down at the sides at the edges of the oblong hole.

3. The fastening plate in accordance with claim 1, wherein an elevation formed as a tenon is disposed in an end region of the bottom plate provided with the dowel-like extension, said elevation reaching into an oblong hole of the top plate parallel to the oblong holes of said bottom plate for guidance and centration.

4. The fastening plate in accordance with claim 1, wherein the bottom plate is symmetrically formed with respect to its tranverse center line and the top plate is symmetrically formed with respect to its longitudinal center line running through center piece.

5. The fastening plate in accordance with claim 1, wherein the dowel-like extension is formed on said second borehole of the bottom plate integrally and of a homogenous material.

6. The fastening plate in accordance with claim 1, wherein the first and second screws are adapted to be mounted in through-holes.

7. The fastening plate in accordance with claim 1, wherein said first borehole is formed in a hexagonal shape.

8. A fastening plate for the fastening of a fitting to a supporting wall comprising a bottom plate provided with two boreholes for fastening screws and with two base-like elevations, a top plate having an elongated center piece and wing-like protrusions provided with oblong holes whose center lines are at right angles to the center line of the elongated center piece, with the base-like elevations engaging the oblong holes of the top plate as guide pieces, one of a dowel-like extension and two bent tongue-like extensions being formed in a region of the bottom plate which lies under the elongated center piece of the top plate when mounted.

9. The fastening plate in accordance with claim 8, such that, when mounted, the bottom plate extends at least essentially a total length of the elongated center piece of the top plate, said dowel-like extension being formed and shaped near an end of the region of the bottom plate underlying the elongated center piece.

10. The fastening plate in accordance with claim 8, wherein at edges of the boreholes of the bottom plate tongues pointing downwards are shaped which simplify centration and correct alignment of the fastening plate.

11. The fastening plate in accordance with claim 8, wherein said two bent tongue-like extensions are formed and edges of the bent tongue-like extensions run at a slight slant relative to their symmetric line.

12. The fastening plate in accordance with claim 8, wherein the boreholes are formed in a hexagonal shape.

13. The fastening plate in accordance with claim 8, wherein said two bent tongue-like extensions are formed in the region of the bottom plate underlying the elongated center piece and edges of said extensions run at a slight slant relative to their symmetric line, and further comprising downward-pointing tongues integrally formed at edges of the boreholes of the bottom plate.

14. A fastening plate in combination with first and second screws for the fastening of a fitting to a supporting wall, said fastening plate comprising a bottom plate and a top plate at least partially covering said bottom plate, said first screw having in its threaded portion a first diameter, and said second screw having in its threaded portion a second diameter smaller than said first diameter, said bottom plate having two base-like elevations and first and second boreholes for receiving said first and second screws, respectively, said top plate having an elongated center piece with wing-like protrusions and oblong holes substantially at right angles to a center line of said center piece, said oblong holes being penetrated by said first and second screws and said base-like elevations extending through the oblong holes of the top plate as guide pieces, said second borehole having a spreading dowel-like extension formed thereon for receiving said second screw, and said first borehole receiving said first screw in its base-like elevation, said first screw being pre-mounted and sized such that the thread of said first screw can cut into a wall of a borehole provided in the supporting wall.

15. The fastening plate in accordance with claim 14, wherein said first borehole is formed in a hexagonal shape.

* * * * *